United States Patent [19]

Ulrich et al.

[11] 4,173,105

[45] Nov. 6, 1979

[54] APPARATUS FOR SEALING CONTAINERS

[75] Inventors: Lawrence W. Ulrich; Connie W. Walker, both of Bolingbrook, Ill.

[73] Assignee: Durable Packaging Corporation, Chicago, Ill.

[21] Appl. No.: 918,787

[22] Filed: Jun. 26, 1978

Related U.S. Application Data

[63] Continuation of Ser. No. 828,272, Aug. 29, 1977, abandoned.

[51] Int. Cl.[2] ..... B65B 7/20

[52] U.S. Cl. ..... 53/374

[58] Field of Search ..... 53/374, 375

[56] References Cited

U.S. PATENT DOCUMENTS

| | | | |
|---|---|---|---|
| 3,031,817 | 5/1962 | Parks | 53/375 X |
| 3,347,017 | 10/1967 | Allen et al. | 53/375 X |
| 4,041,675 | 8/1977 | Loveland et al. | 53/374 X |
| 4,044,527 | 8/1977 | Ulrich et al. | 53/374 X |

*Primary Examiner*—Travis S. McGehee

*Attorney, Agent, or Firm*—Joel E. Siegel

[57] ABSTRACT

An apparatus for automatically sealing random sized cartons which includes an improved mechanism to automatically move the carton centering side arms towards and away from the carton.

1 Claim, 3 Drawing Figures

APPARATUS FOR SEALING CONTAINERS

This is a continuation, of application Ser. No. 828,272, filed Aug. 29, 1977, now abandoned.

BACKGROUND AND SUMMARY OF THE INVENTION

The present invention relates to apparatus for the sealing of packaging containers, and more particularly to apparatus for automatically sealing the foldable flaps of cartons of random sizes by applying a self-adhesive tape material along the edges of the flaps.

In the packaging industry, corrugated and fiberboard cartons have been used for many years and various machines have been developed which are capable of sealing the carton either by gluing the flaps, taping the flaps or by stapling or otherwise providing mechanical fasteners to maintain the flaps in a closed position. Many of these machines are designed to accept cartons of random width and height by providing various types of sensing means to control the transverse movement of carton centering side arms and the vertical movement of the top sealing means. Over the years these machines have tended to become more complex and expensive and less reliable in operation.

A good example of the type apparatus this invention is directed towards is disclosed in U.S. patent application Ser. No. 700,170, having the same inventive entity and assignee as the present invention. The present invention is an alternative and less expensive mechanism to achieve a similar result.

It is a primary object of the invention to provide an apparatus for automatically sealing the foldable flaps of random sized cartons which is simple in design and reliable in operation.

Another object of the invention is to provide such an apparatus having an improved mechanism to automatically move the carton centering side arms towards and away from the carton.

The present invention described herein provides an apparatus for automatically sealing random sized cartons in a simple and reliable manner. A unique side arm control mechanism is provided to control the transverse movement of the carton centering side arms. The control mechanism includes a pneumatic cylinder associated with one of the side arms and operable to transversely move same towards and away from the longitudinal axis of the apparatus. A unique connecting linkage is provided to translate simultaneous movement to the other side arm. For a fuller understanding of the nature and objects of the invention reference should be made to the following detailed description taken in connection with the accompanying drawings.

DESCRIPTION OF A PREFERRED EMBODIMENT

Figure 1:
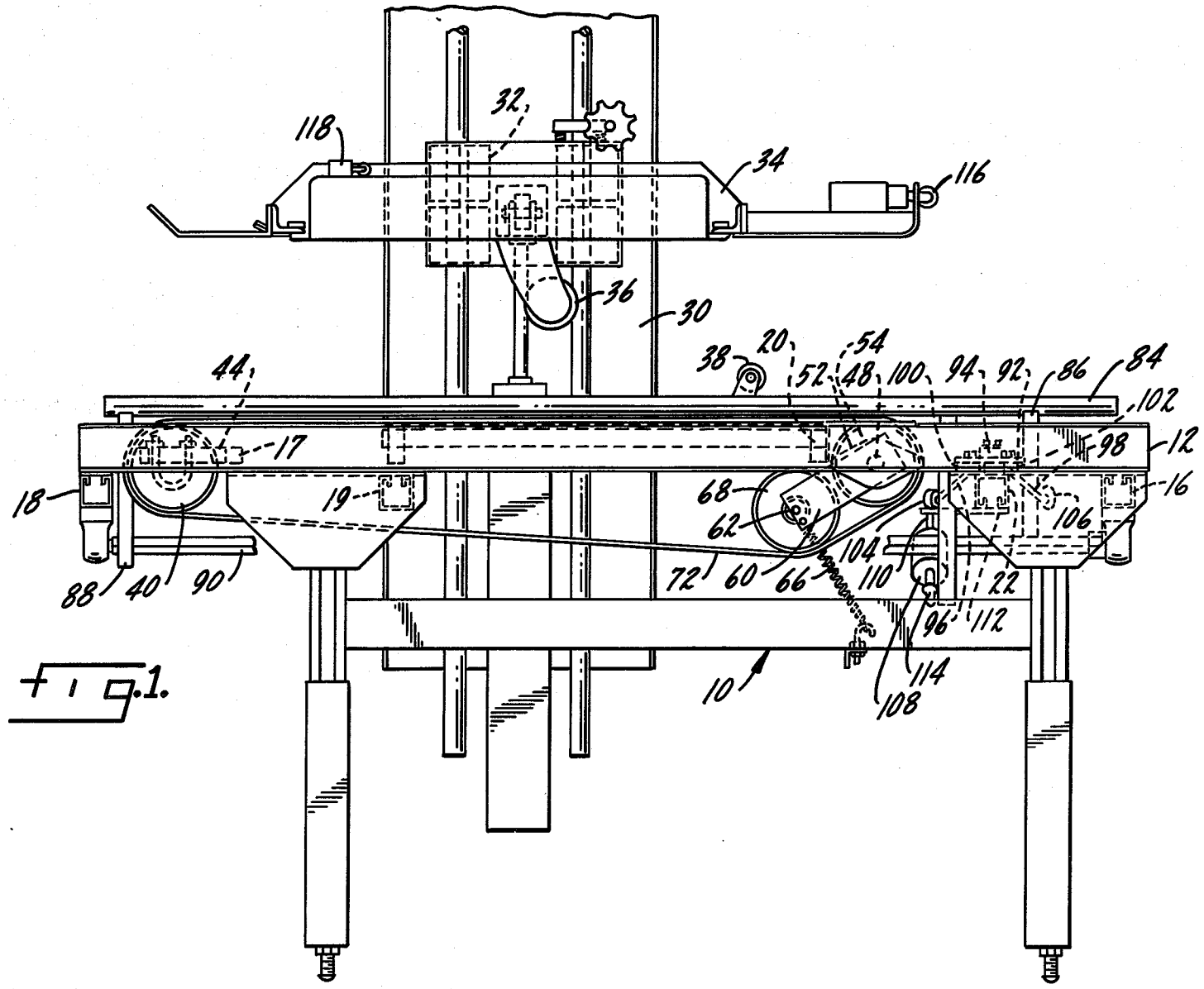
FIG. 1 is a front elevational view of the carton sealing apparatus constructed in accordance with the present invention.
Figure 2:
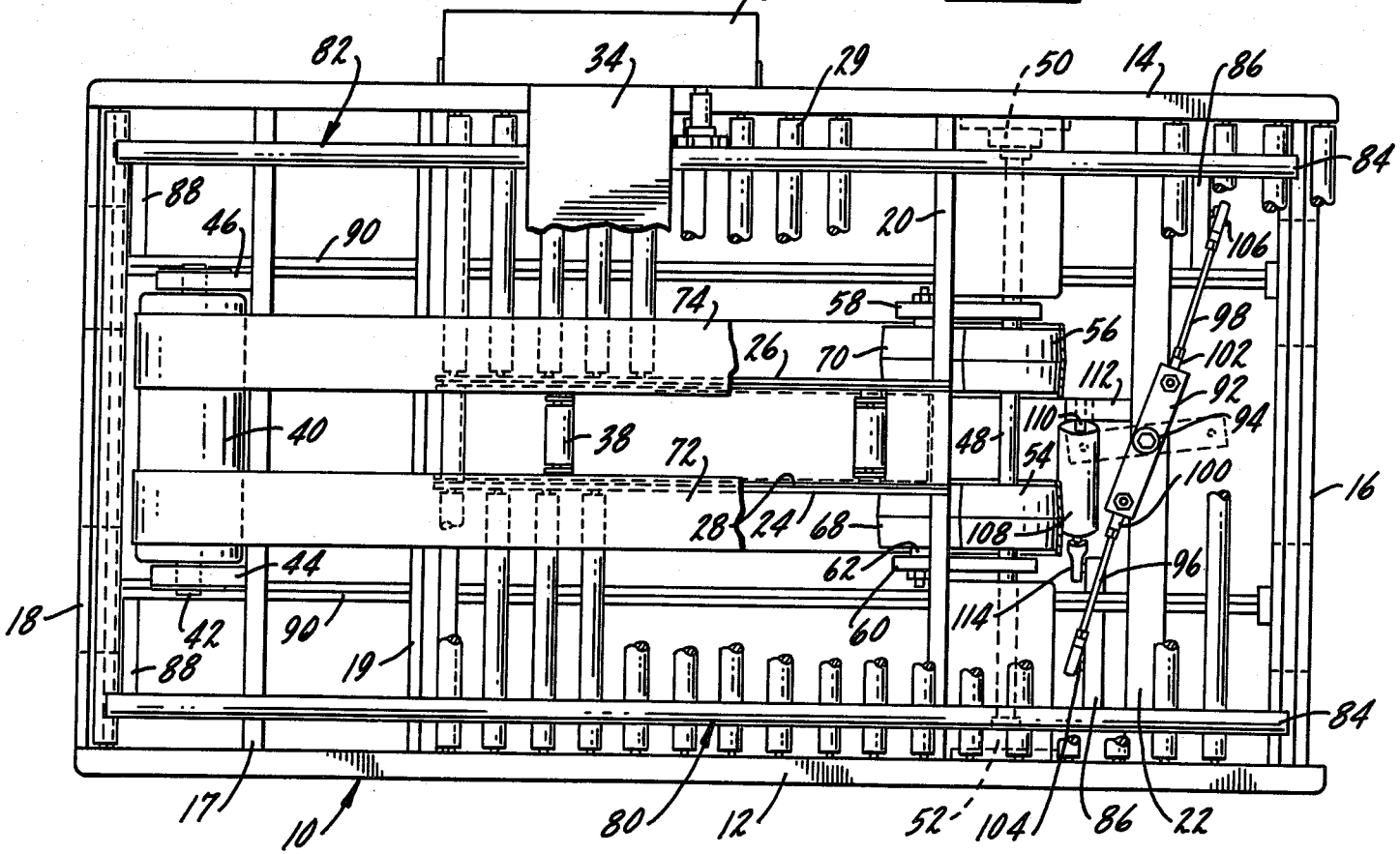
FIG. 2 is a top plan view, partially broken away, of the apparatus shown in FIG. 1.

Referring now in detail to the drawings and particularly to FIGS. 1 and 2; the apparatus in accordance with the present invention includes a frame structure assembly 10 having side walls 12 and 14 and end walls 16 and 18. Extending between side walls 12 and 14 are structural members 17, 19, 20 and 22. A pair of longitudinally extending structural members 24 and 26 extend between members 19 and 20 so as to define a rectangular opening 28 therebetween. A plurality of transversely disposed and longitudinally spaced carton conveying rollers 29 are journalled for rotation between the side walls 12 and 14 and between the members 24 and 26 and the respective side walls 12 and 14, as best seen in FIG. 2. Extending vertically upward from side wall 14 in transverse alignment with opening 28 is a structural vertical lift housing 30. Positioned within housing 30 is a vertical lift assembly 32. Secured to lift assembly 32 is a tape head support assembly 34 which is supported above the longitudinal center axis of frame 10. An upper tape sealing head 36 is secured to assembly 34. A lower tape sealing head 38 is secured to frame 10 within opening 28.

The specific structure of housing 30, lift assembly 32, support assembly 34, and the tape sealing heads 36 and 38 are not deemed an important part of the present invention. Reference is made to U.S. patent application Ser. No. 700,170 for a more detailed disclosure of some of these components.

A power driven pully assembly 40 is journalled for rotation about a shaft 42 which is secured to member 17 through members 44 and 46. An idler shaft 48 extends between side walls 12 and 14 for rotation within bearings 50 and 52. A pair of pulleys 54 and 56 are secured to shaft 48 for rotation therewith. Tension brackets 58 and 60 are pivotally secured at their ends about shaft 48 immediately outside of pulleys 54 and 56. A tension shaft 62 extends between the other ends of brackets 58 and 60. Spring members 64 and 66 are secured at one end to respective brackets 58 and 60 and at their other ends to frame 10. Tension pulleys 68 and 70 are secured to shaft 62 in respective longitudinal alignment with pulleys 54 and 56. A first endless conveyor belt 72 is trained about pulleys 40, 54 and 68 and a second endless conveyor belt 74 is trained about pulleys 40, 56, and 70. The bias of springs 64 and 66 is effective to pivot brackets 58 and 60 and the pulleys 68 and 70 associated therewith and thereby retain adequate tension in belts 72 and 74.

Figure 3:
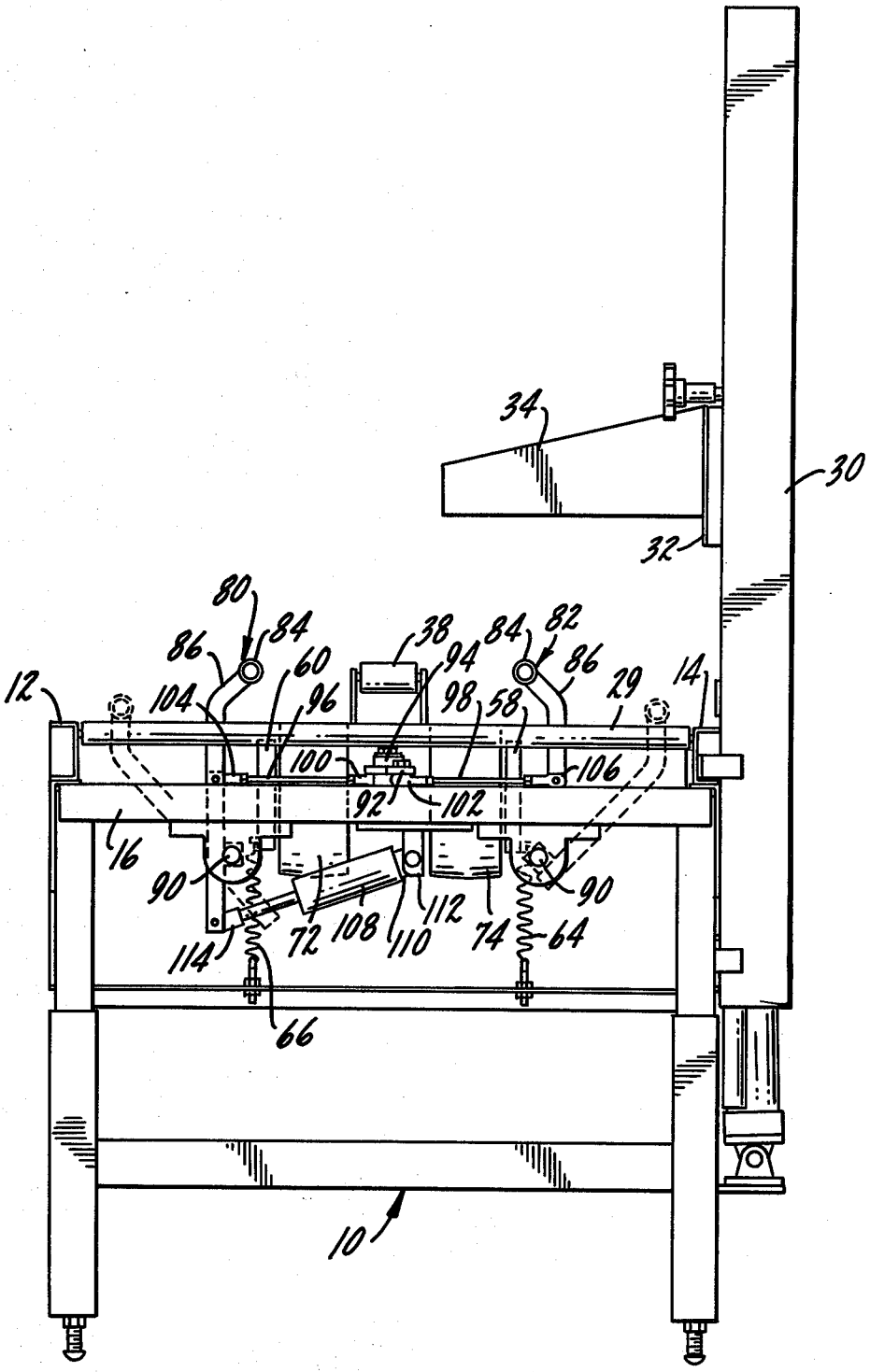
FIG. 3 is a side elevational view showing the side arm control mechanism.

Referring to FIGS. 2 and 3, a pair of longitudinally extending side arm assemblies 80 and 82 are pivotally mounted to frame 10 on opposite sides of the longitudinal axis of the apparatus. Each of side arm assemblies 80 and 82 includes a longitudinal side arm 84 which is secured to the upper ends of a pair of side arm brackets 86 and 88. Side arm brackets 86 and 88 are rigidly secured to longitudinally extending rods 90 which extend between and are rotatably mounted to end walls 16 and 18. An operator plate 92 is rotatably mounted to frame member 22 at bearing 94. The opposite ends of operator plate 92 are respectively secured to the brackets 86 associated with each of the side arm assemblies 80 and 82 by tie rods 96 and 98. The inner ends of tie rods 96 and 98 are respectively secured to corresponding ends of operator plate 92 by universal fittings 100 and 102. The outer ends of tie rods 96 and 98 are respectively secured to intermediate portions of the brackets 86 by universal fittings 104 and 106. A pneumatic cylinder 108 is provided to selectively pivot side arm assembly 80 by rotating the corresponding rod 90. Air cylinder 108 has a first end 110 pivotally mounted to a rigid cylinder mounting 112 and a second end 114 pivotally mounted to the lower end of the bracket 86.

To control the sequential movement of the vertical lift assembly 32 and the side arm assemblies 80 and 82, a pair of pneumatic switches 116 and 118 are provided to sense the relative position of the carton as it enters and proceeds through the apparatus. Pneumatic switch 116 is positioned on the leading edge of support assembly 34. Pneumatic switch 116 is operative to contact the leading surface of the carton and thereby activate the upward movement of vertical lift assembly 32 and inward movement of side arm assemblies 80 and 82. The deactivation of switch 116 as the carton moves through the apparatus is effective to lower vertical lift assembly 32 until the tape head support assembly 34 contacts the top of the carton. Pneumatic switch 118 is positioned on the rear end of support assembly 34 and is activated as the taping cycle is completed so as to move side arm assemblies 80 and 82 outward and vertical lift assembly 32 upward. Pneumatic switch 118 has a short time built-in delay after which it is effective to move lift assembly 32 to its lowermost position after the carton has been removed from the apparatus. The specific pneumatic system and switching system required to function in the manner hereinabove described is of conventional design and not an integral part of the present invention, and consequently a detailed description thereof is not deemed necessary.

The modus operandi of the apparatus in accordance with the invention will now be described with reference to the drawings as described above.

At the start of operation, side arm assemblies 80 and 82 are in their outermost positions, as shown in dotted lines in FIG. 3, and lift assembly 32 is in its lowermost position. Power is continuously supplied to pulley assembly 40 effecting the continuous movement of belts 72 and 74.

The carton to be sealed is positioned on the rollers 29 adjacent the end wall 16. The upper flaps of the carton are infolded either manually by the operator or automatically by a flap closing mechanism (not shown) of a type well known in the art. The carton is positioned on rollers 29 such that the longitudinal edges of the carton flaps are in substantial alignment with the longitudinal center axis of frame structure 10. The carton is moved inwardly until the leading side of the carton pushes against and activates pneumatic switch 116. The activation of switch 116 activates lift assembly 32 causing same to rise until contact is broken as the leading upper edge of the carton passes under switch 116. The activation of switch 116 also simultaneously activates pneumatic cylinder 108 which pivots side arm bracket 86 and rod 90 in a clockwise direction until side arm 84 contacts the side of the carton. The inward movement of bracket 86 is effective to push on rod 96 so as to rotate plate 92 which in turn pulls on rod 98 and pivots the other bracket 86 inwardly causing side arm 86 to move into contact with the other side of the carton. The simultaneous movement of side arms 84 is effective to initially center the carton on the longitudinal center axis of the apparatus and retain that position as it moves through the apparatus.

The carton is then moved inwardly onto belts 72 and 74 which continue the movement of the carton past the taping heads 36 and 38. As the carton is moved past the taping heads a strip of sealing tape is applied across the top and bottom surfaces and portions of the end surfaces of the carton, sealing the flaps in a closed position.

Upon completion of the taping cycle, the pneumatic switch 118 is activated which activates cylinder 108 and returns side arm assemblies to their outermost position. The activation of switch 118 also simultaneously raises lift assembly 32 for a predetermined period of time to facilitate removal of the carton and then returns it to its lowermost position. The sealed carton is removed from the apparatus adjacent end wall 18 and the procedure is repeated for the next carton.

The foregoing is a description of a preferred embodiment of the invention which is given here by way of example. The invention is not to be taken as limited to any of these specific features as described, but comprehends all such variations thereof as come within the scope of the appended claims.

We claim:

1. Apparatus of the type used for sealing the foldable flaps of cartons of random sizes, said apparatus including a frame structure, a vertically movable sealing head means mounted to said frame structure, a longitudinally extending bottom belt carton conveying means rigidly mounted to said frame structure, and an improved side arm assembly means engagable with opposite sides of said carton for centering and guiding said carton through said sealing head means; said side arm assembly comprising:

(a) first and second longitudinally extending side arm members positioned on opposite sides of the longitudinal center axis of said apparatus, said side arm members being mounted to and extending upward from said frame structure for pivotal movement about a substantially horizontal axis;

(b) a pneumatic cylinder having a first end pivotally secured to said frame structure and a second end pivotally secured to said first side arm member so as to effect pivotal movement of said first side arm member towards and away from the longitudinal center axis of said apparatus;

(c) a flat plate member rotatably mounted about a vertical axis to said frame structure along the longitudinal center axis of said frame structure and outside the longitudinal extent of said carton conveying means; and (d) first and second straight tie rods having first ends universally secured to opposing ends of said plate member and second ends universally secured to a respective first and second side arm member such that pivot movement of said first side arm member is translated through said first tie rod to rotate said plate member which in turn translates a simultaneous pivotal movement to said second side arm member through said second tie rod.

* * * * *